United States Patent [19]

Grabowski

[11] Patent Number: 4,535,514

[45] Date of Patent: Aug. 20, 1985

[54] SEAT BELT WITH PLASTIC COVER

[75] Inventor: Richard M. Grabowski, Country Club Hills, Ill.

[73] Assignee: Gateway Industries, Inc., Hazel Crest, Ill.

[21] Appl. No.: 423,813

[22] Filed: Sep. 27, 1982

[51] Int. Cl.[3] ..... A44B 11/26

[52] U.S. Cl. ..... 24/633; 24/637; 24/643

[58] Field of Search ..... 24/633–646

[56] References Cited

U.S. PATENT DOCUMENTS

| | | | |
|---|---|---|---|
| 3,605,209 | 9/1971 | Alarcon | 24/230 |
| 3,795,030 | 3/1974 | Yates et al. | 24/637 |
| 3,996,648 | 12/1976 | Romanzi, Jr. | 24/230 A |
| 4,060,879 | 12/1977 | Takada | 24/637 |
| 4,062,091 | 12/1977 | Holmberg | 24/637 |
| 4,064,603 | 12/1977 | Romanzi, Jr. | 24/230 A |
| 4,232,433 | 11/1980 | Ueda et al. | 24/637 |
| 4,368,563 | 1/1983 | Lentz | 24/230 A |
| 4,391,023 | 7/1983 | Tanaka et al. | 24/633 |

FOREIGN PATENT DOCUMENTS

| | | | |
|---|---|---|---|
| 1369552 | 10/1974 | United Kingdom | 24/633 |

*Primary Examiner*—William E. Lyddane
*Assistant Examiner*—Peter A. Aschenbrenner
*Attorney, Agent, or Firm*—Fitch, Even, Tabin & Flannery

[57] ABSTRACT

A one-piece plastic safety belt buckle cover employs integral structural members depending from the inside of the top portion of the cover to support it and give it strength and rigidity to resist crushing under vertical loading. The preferred structural members comprise a latticework or honeycomb of intersecting walls and ribs defining supports at the front, sides and rear of the cover. The front support is positioned above a tongue plate and spaced therefrom to engage the tongue plate when the front of the cover is deflected downward. The preferred supports include walls which extend downward inside the cover shell and are positioned to engage various surfaces of the buckle when the cover is deflected downward due to vertical loading, and include ribs which do not extend as far downward, but which also support the outer shell of the cover.

8 Claims, 7 Drawing Figures

SEAT BELT WITH PLASTIC COVER

The present invention relates generally to a safety belt buckle and more particularly to an improved cover which fits over the top of a safety belt buckle.

Safety belt buckles of the type having a locking mechanism which may be released by application of downward pressure to a push button located on top of the buckle, such as the buckle described in U.S. Pat. No. 4,064,603 to Romanzi, are commonly used to fasten together the ends of safety belts which function to restrain occupants of automobiles and other vehicles to prevent or reduce injuries during collisions. Safety belt buckles to be used in automobiles are subject to federal safety standards which require that each buckle be able to pass certain tests. In one test, a rod of $\frac{3}{4}$ in. diameter curved at a 6 in. radius is rolled over the top of the buckle to apply 400 lbs. of pressure to the cover. In order to pass the test, the cover must have sufficient strength and rigidity to bear the 400 lb. load without permitting deflection of the button to the point where the locking mechanism is released.

To obtain the strength and rigidity necessary to comply with federal requirements, seat belt buckles have heretofore used covers made entirely of metal, such as the cover described in U.S. Pat. No. 4,064,603 to Romanzi, or have used covers made of plastic but supported by metal structural members, such as the covers described in U.S. Pat. Nos. 3,605,209 to Alarcon and 3,996,648 to Romanzi.

The metal cover described in U.S. Pat. No. 4,064,603 to Romanzi is supported externally around its periphery. The flexural strength of the metal is sufficient to resist breaking of the central portion of the cover under the 400 lb. test load. Due to the lower strength of plastic, a plastic cover having an identical configuration would not be able to withstand vertical loading of the type described above without collapsing. The plastic covers shown in U.S. Pat. Nos. 3,605,209 to Alarcon and 3,996,648 to Romanzi are not self-supporting, but rely on underlying metal structural members to provide resistance to crushing under vertical loading.

Metal covers such as that shown in U.S. Pat. No. 4,064,603 to Romanzi are relatively expensive due to material cost and due to costs of finishing their exteriors, which are made more esthecially pleasing by operations such as painting them to match the color of a car interior. Plastic covers have advantages in that they can be made in various colors without requiring a separate painting, and plastic is relatively inexpensive. However, plastic covers have heretofore had the disadvantage of requiring metal structural members to support them, which adds to the cost of the buckle. It has been a goal of the seat belt buckle industry to produce a less expensive cover made entirely of plastic which would provide the requisite load-handling characteristics without requiring metal structural supports, and which would have the additional advantage of presenting an attractive external surface without requiring a coating of paint. Attempts to produce such a cover from plastic have heretofore been unsuccessful due to structural failure of plastic covers under vertical loading.

Accordingly, it is an object of the present invention to provide an inexpensive, self-supporting plastic safety belt buckle cover having the strength and rigidity required to meet federal and commercial safety standards for use in automobiles.

Further objects and advantages of the present invention are more particularly set forth in the following detailed description and the accompanying drawings in which.

Figure 7:
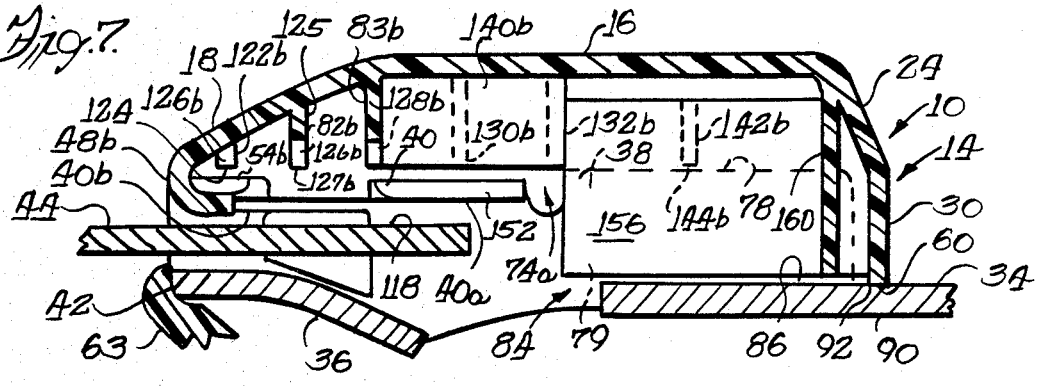
FIG. 7 is an enlarged fragmentary sectional elevational view of the buckle of FIG. 1 taken substantially along lines 7—7 in FIG. 4.

The present invention is generally embodied in a top cover, indicated generally at 10, for a metal safety belt buckle, indicated generally at 12. The cover herein has an outer shell, indicated generally at 14, which includes a top 16 having an inclined front portion 18, left and right inclined side portions 20 and 22 respectively adjacent thereto, and an inclined rear portion 24, all sloping upward toward the center of the top to define a lip 26 around a recessed opening 28 in the shell. The outer shell further includes a back wall 30 (FIGS. 2 and 7) depending from the rear portion of the top.

Figure 5:
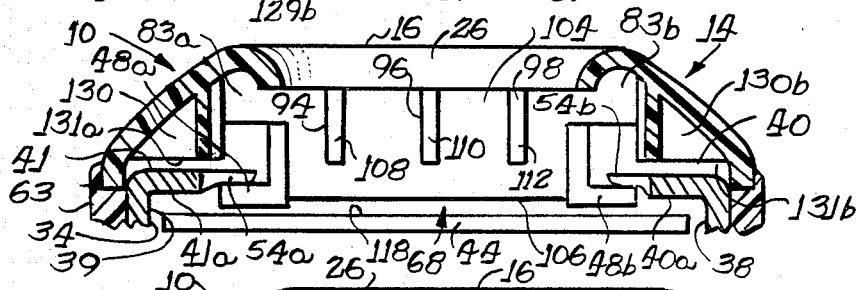
FIG. 5 is an enlarged fragmentary sectional elevational view of the buckle of FIG. 1 taken substantially along lines 5—5 in FIG. 4.

The buckle includes a locking mechanism, indicated generally 32 (FIG. 2) mounted in a buckle frame 34. The buckle frame, as best viewed in FIG. 3, has a contoured, perforated bottom 36 and upstanding sides 38 and 39. The bottom and sides of the buckle frame define a channel for receiving a tongue plate 44 at the front end of the frame. Upper portions of the sides are turned inward near a front end 42 of the buckle frame to form ears 40 and 41 positioned so that their lower surfaces **40*a* and 41*a* (FIG. 5) guide the tongue plate as it is inserted into the channel. The locking mechanism 32 (FIG. 2) locks the tongue plate in place upon insertion of the tongue plate into the channel. The locking mechanism may be released by depressing a push-button 46 which is accessible through the opening 28 in the top of the cover 10**.

The cover is secured to the buckle frame by two hooks **48*a* and 48*b* depending from a front end 52 of the cover which engage lugs 54*a* and 54*b* on the buckle frame, and by a clip 58 depending from a bottom edge 60 of the back wall 30 which is inserted through an opening 62 in the buckle frame 34 to engage the underside of the frame. The cover 10 herein is the upper section of a two-piece housing. A lower section 63 of the housing partially encases the bottom 36 of the buckle frame and the upstanding sides 38, and is secured to the frame by a clip 64 which extends upward through the same opening used by the clip 58 depending from the cover, and a lip 66 which wraps around the front end 42** of the buckle frame.

To provide sufficient strength to meet federal safety standards, safety belt buckle covers have generally been made of metal or supported by metal structural members. With plastic buckles the metal structural members were positioned to span the channel sides 38 and 39 to support the cover top wall adjacent the opening for the push button. Without such support from a metal structural member the plastic cover would crack when subjected to the 400 lb. test load. There is a need for plastic cover having sufficient strength and rigidity to provide the requisite load-bearing capabilities.

Figure 4:
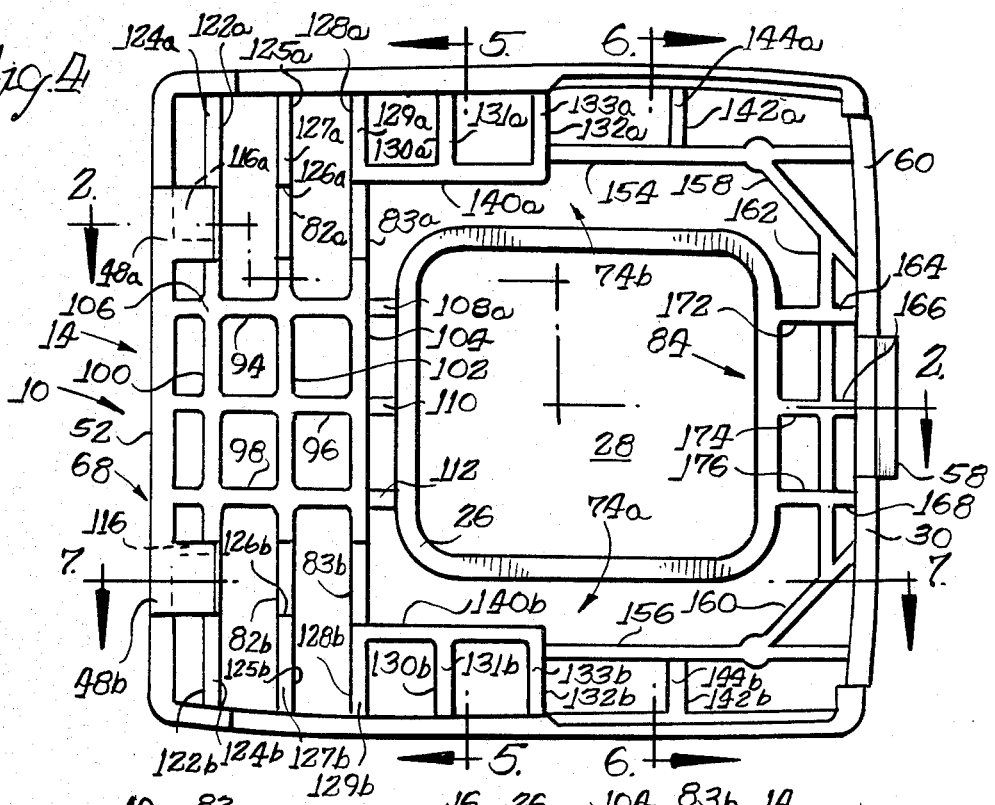
FIG. 4 is an enlarged bottom view of the cover of FIG. 1.

In accordance with the present invention, an inexpensive plastic safety belt buckle cover 10 is provided which includes integral structural supports or members depending from the top portion of the cover to support it and give it strength and rigidity to resist crushing under vertical loading. As will be apparant from FIGS. 4, 5 and 6, the preferred structural supports provide a generally ribbed honeycomb appearance to the underside of the cover. As will be explained, this ribbed honeycomb support provides strength and a fast molding cycle time as contrasted with a thick solid wall structure. In the preferred embodiment an integral front support, indicated generally at 68, depends from the front portion 18 of the top 16 of the outer shell 14 and is spaced from the tongue plate 44 by a relatively small distance so that downward deflection of the top of the cover under vertical loading brings this support 68 into contact with the tongue plate. The tongue plate and underlying portions 70 and 72 (FIG. 2) of the buckle 12 thus bear part of the load applied to the cover and limit the deflection of the top of the cover. To prevent crushing of side portions 20 and 22 of the shell under vertical loading, left and right side supports, indicated generally at 74*a* and 74*b* respectively and best viewed in FIG. 4, are positioned on opposite sides of the cover to engage the ears 40 and 41 and top surfaces 78 and 80 of rear portions of the upstanding sides 38 and 39 of the buckle frame. Ribs 82*a*, 82*b*, 83*a* and 83*b* extend from the side supports to the front support 68 to add stiffness to the front of the cover. The rear portion 24 of the top of the shell 16 is strengthened by a rear support, indicated generally at 84, which is integrally attached to the back wall 30 and which is positioned to engage a generally planar rear portion 86 of the buckle frame. In the preferred embodiment, the cover 10 is a one-piece plastic molding and the supports 68, 74*a*, 74*b* and 84 are integrally attached to the outer shell.

Turning now to a more detailed description of a preferred embodiment of the present invention, the cover 10 is secured to the buckle frame 34 by two hooks 48*a* and 48*b* and a clip 58. The hooks depend from the front end 52 of the cover and define rearwardly facing slots to receive lugs 54*a* and 54*b* extending inwardly from the ears 40 and 41 at the front of the buckle frame. The clip 58 depends from the back wall 30 of the cover and snaps into the opening 62 near the rear of the buckle frame. In assembling the buckle, the hooks are first placed on the lugs, and the clip is then pushed downward into the opening so that a rearwardly extending shoulder on the clip defines catch surface 88 (FIG. 2) which engages a lower surface 90 of the bottom of the buckle frame adjacent to the opening. The bottom edge 60 of the back wall 30 presses against a top surface 92 of the bottom of the buckle frame adjacent to the opening. To make the clip hold the cover tightly against the buckle frame, the catch surface 88 of the clip 58 is spaced from the bottom edge 60 of the back wall 30 by a distance approximately equal to the thickness of the bottom of the buckle frame near the opening.

The various supports include vertical walls which preferably are dimensioned so that their bottom surfaces are spaced by a narrow margin from their associated load-bearing surfaces on the buckle frame and tongue. Application of a large vertical load to the top of the cover causes deflection of the cover so that the bottom edges of these walls descend to the load-bearing surfaces and act to uphold the outer shell. It will be appreciated that the function of the walls could also be accomplished if their bottom edges were in contact with the load-bearing surfaces prior to loading. The primary reason for the clearances is to allow for variations in the dimensions of the covers which may occur in mass producing the covers by injection molding. If all of the walls were to be in contact with their associated load bearing surfaces when the buckle is in its unloaded configuration, a relatively small excess in the height of a wall would make it difficult to insert the clip 58 far enough into the opening to allow the catch surface 88 to engage its associated buckle frame surface 90. In the preferred embodiment, only the bottom edge 60 of the back wall 30 limits the travel of the clip 58 into the opening 62.

Referring now to FIG. 4, each of the preferred supports includes a plurality of vertical walls extending downward from the outer wall. The front support comprises three longitudinal walls 94, 96 and 98 and three transverse walls 100, 102 and 104 intersecting the longitudinal walls, all of which depend from the shell 14 so that their bottom edges form a generally planar, lattice-like surface 106 to engage the tongue plate. Rearward edges 108, 110 and 112 of the longitudinal walls extend obliquely upward from the bottoms of the walls to the lip 26 around the rectangular opening in the cover. The forward ends of the longitudinal walls abut the front portion 18 of the top 16 of the outer shell. The foremost transverse wall 100 has its opposite ends abutting braces 116 which extend vertically between the inner surface of the shell 14 and the hooks 48*a* and 48*b* to reinforce the hooks. The other two of the transverse walls 102 and 104 are contiguous with the ribs 82*a*, 82*b*, 83*a* and 83*b* which extend transversely from each side of the front support to the side supports. The bottom edges of the ribs are not positioned to contact parts of the buckle. The function of the ribs is primarily to add stiffness to the cover.

Figure 1:
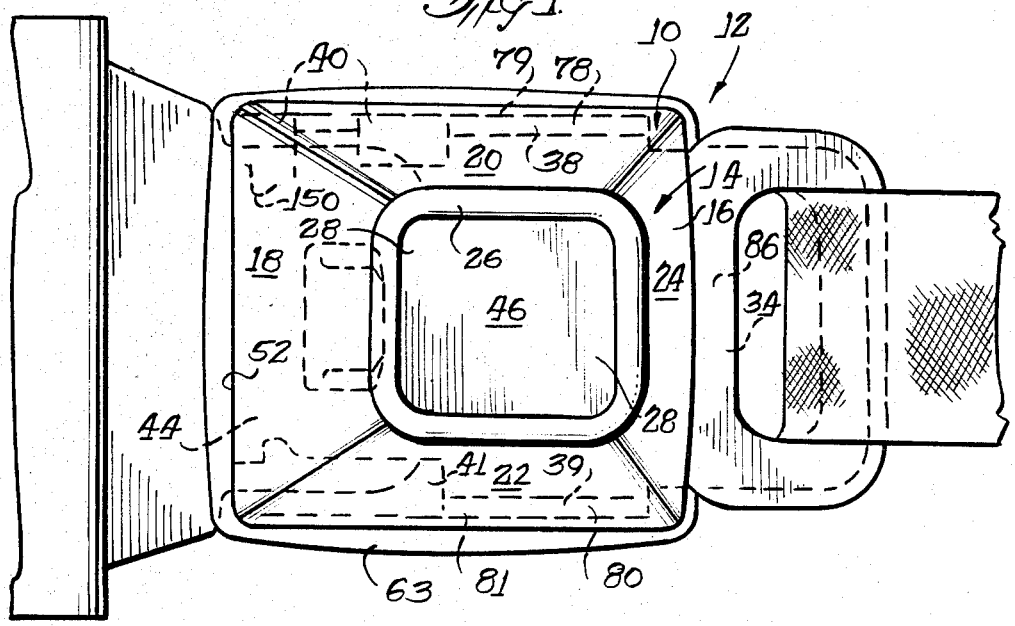
FIG. 1 is an enlarged plan view of a safety belt buckle having a cover embodying the present invention.
Figure 2:
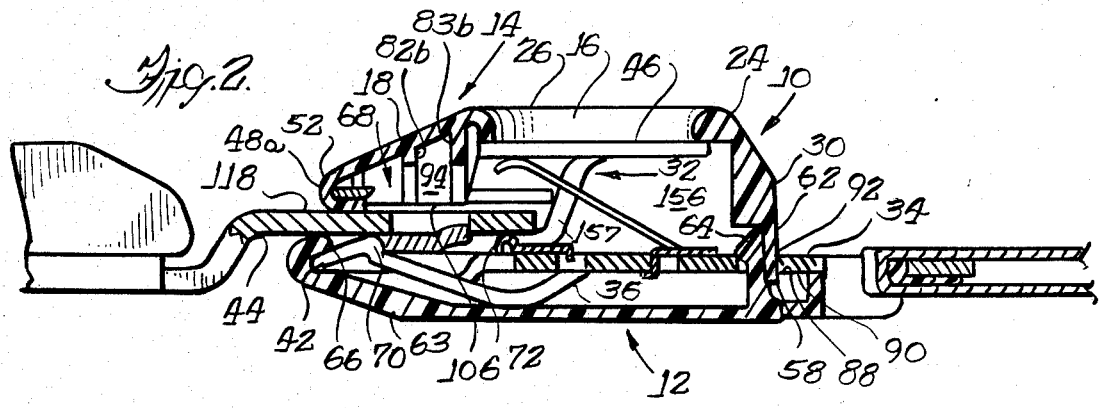
FIG. 2 is an enlarged sectional elevational view of the buckle of FIG. 1 taken substantially along lines 2—2 in FIG. 1 and FIG. 7.

Referring now to FIG. 2, when the buckle is in assembled relation with the tongue plate 44 locked in place, the front support 68 is spaced from an upper surface 118 of the tongue plate by a small distance. Downward pressure on the top of the cover causes downward deflection of the front support so that part of its bottom surface 106 contacts the upper surface 118 of the top of the tongue plate and transmits a portion of the load to the tongue plate. The tongue plate is supported from beneath by various portions 70 and 72 of the buckle, so that the tongue plate is capable of withstanding substantial vertical loading from the front support without yielding.

Figure 6:
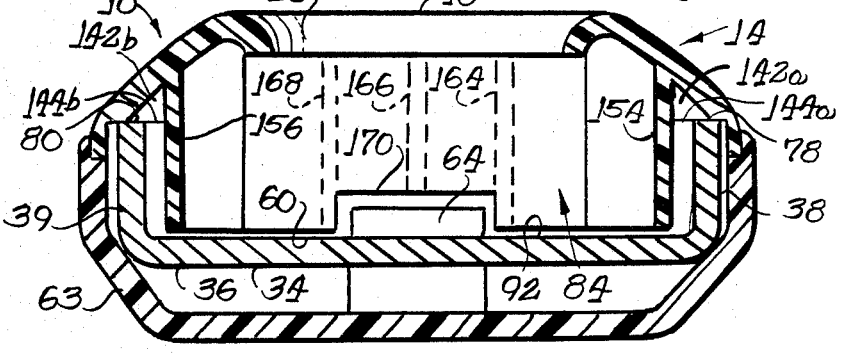
FIG. 6 is an enlarged fragmentary sectional elevational view of the buckle of FIG. 1 taken substantially along lines 6—6 in FIG. 4.

Referring to FIG. 4, the side supports 74*a* and 74*b* are symmetrically identical, and their corresponding components are designated herein by identical numbers with the letters "a" and "b" to designate components of the left and right supports respectively. Only the left side support 74*a* will be described in detail herein. At the front of the left side support is a first transverse wall 122*a* which is approximately triangular in shape, having a horizontal bottom edge 124*a*, a vertical inner edge 126*a* and an oblique outer edge (not shown) which abuts the inner surface of the outer shell. A second transverse wall 125*a* is formed to the rear of the first wall and is similarly shaped with a horizontal bottom edge 127*a* and vertical inner edge 126*a*. Third, fourth, and fifth transverse walls 128*a*, 130*a*, and 132*a* respectively are disposed in that order to the rear of the second wall and are also approximately triangular in shape. The third, fourth, and fifth transverse walls have horizontal bottom edges 129*a*, 131*a*, and 133*a* respectively, and are joined at their inner ends by a longitudinal wall 140*a* which extends from the third wall 128*a* to the fifth wall 132*a*. A sixth transverse wall 142*a* of the side support is formed to the rear of the fifth wall 132*a*, and, as best viewed in FIG. 6, is similarly shaped with a horizontal bottom edge 144*a*.

Figure 3:
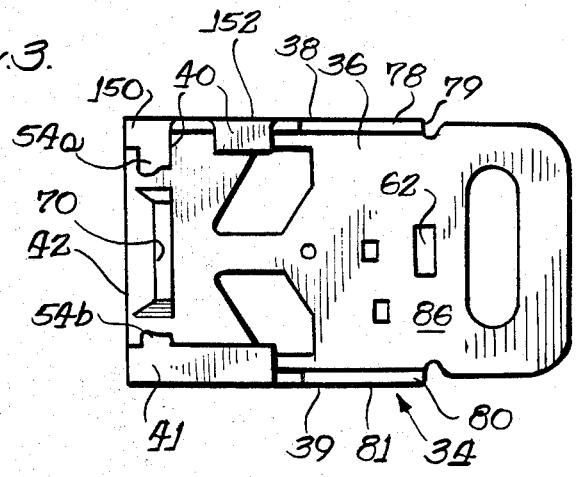
FIG. 3 is a plan view of a buckle frame of the buckle of FIG. 1.

The bottom edges of the various walls included in the side supports 74*a* and 74*b* are positioned so that downward deflection of the outer shell 14 brings them into contact with the upstanding sides 38 and 39 of the buckle frame. Upper portions of the sides of the buckle frame 34 are turned inward near the front of the buckle to form ears 40 and 41 for front portions of the side supports 74*a* and 74*b* to engage. The ear 40 on the left side of the frame, as best viewed in FIG. 3, is notched for reasons relating to assembly. As best viewed in FIG. 7, the first transverse wall 122*a* of the left side support is positioned to engage a part 150 of the notched ear which is in front of the notch. The second and third transverse walls 125*a* and 128*a* and the longitudinal wall 140*a* are positioned to engage the part 152 of the notched ear 40 which is behind the notch. The ear 41 on the right side of the frame 34 is not notched. The right side support 74*b* engages the right ear 41 with its four foremost transverse walls 122*b*, 125*b*, 128*b* and 130*b* and its longitudinal wall 140*b*. The sixth transverse walls 142*a* and 142*b* of each side support 120 engage the top surfaces 78 and 80 of the upstanding sides 38 and 39 of the buckle frame. The fifth transverse walls 132 of the side supports do not contact the buckle frame, and serve primarily as stiffening members.

Referring again to FIG. 4, the rear support 84 is positioned directly adjacent to the back wall 30 of the outer shell 14 and between the sixth transverse walls 142*a* and 142*b* of the side supports, and is symmetrical with respect to a longitudinal axis through the cover. Parallel left and right outer walls 154 and 156 extend longitudally from the back wall 30 toward the front of the cover. A front end of each outer wall abuts the fifth transverse wall 132 of the side support on each side. In addition to performing a structural function, the outer walls 154 and 156 aid in centering the cover during assembly by engaging opposite sides of two arms 157 (FIG. 2) which support the button 46. The walls 154 and 156 are much deeper than the walls which engage the side walls 38 and 39 of the frame.

Left and right diagonal walls 158 and 160 extend between the outer walls of the rear support and the back wall. The diagonal walls are joined by a transverse wall 162 which is substantially parallel to the back wall and spaced therefrom by three short longitudinal walls 164, 166 and 168. A notch 170 (FIG. 6) is formed at the bottom of the transverse wall 162 to accommodate the clip 64 which extends upward through the opening 62 in the frame to secure the lower section 63 of the housing to the frame. Three ribs 172, 174 and 176 aligned with the longitudinal walls join the transverse wall 162 to the lip 26 to reinforce the rear support 84.

The preferred cover is manufactured by injection molding and is composed of plastic. The plastic may be reinforced with fibrous material if extra strength is required. It is desirable to use only as much plastic as is necessary to meet the strength and rigidity requirements discussed above. Use of excess material adds to the cost of the cover, and the thickness of the material affects the cycle time of the injection molding process. For example, where thermoplastic material is used the molded product is cooled before being removed from the mold. The cooling time of the product increases as wall thickness increases. In addition, distortion of the wall shape due to contraction of the plastic during cooling becomes more significant as wall thickness increases. For these reasons, employment of solid support members made up of blocks of plastic rather than structures of walls and ribs would be unsatisfactory. In the preferred embodiment, the various walls and ribs have a thickness of 1 mm., and the outer shell has a thickness of 1.5 mm. These dimensions have been found to provide a cover having the requisite load-bearing capabilities without using excessive amounts of plastic, while also allowing a satisfactory cycle time.

From the foregoing it will be seen that an improved safety belt buckle cover is provided which is formed inexpensively from plastic and which employs integral support members to provide it with the strength and rigidity necessary for use in the automobile industry. The support members include a lattice structure formed of integral walls and ribs depending from the inner side of the shell of the cover and are positioned to provide structural support and stiffness.

While a preferred embodiment has been shown and described, it will be understood that there is no intent to limit the invention by this disclosure. The invention includes all modifications and alternate constructions falling within the spirit and scope of the invention as defined in the appended claims.

What is claimed is:

1. In a safety belt buckle, the combination comprising:

a generally channel shaped frame having a bottom wall and a pair upstanding side walls, a tongue plate slideable along the bottom wall of the frame, latch means mounted in the frame for movement between a latched position for holding the tongue plate against removal and an unlatched position allowing removal of the tongue plate from the frame, a push button operator for shifting the latching means from the latched position to the unlatched position, a bottom plastic cover for the covering the bottom wall of the channel shaped frame and having sidewalls for upwardly along the upstanding side walls of the frame, and a one-piece plastic top cover having a shell for covering the upper open side of the channel shaped frame and having an opening exposing the pushbutton operator for operation by a user, a plurality of side ribs on each side of the top over depending internally from the shell for engaging the side walls of the channel shaped frame and for supporting the cover shell thereabove, said bottom cover and said top cover abutting each other adjacent the frame side walls, a rear support having ribs depending internally at the rear of the shell for positioning to abut the frame bottom wall, a back wall on the shell extending to abut the bottom wall of the frame at the rearward side of the buckle, and a front support having a plurality of ribs depending internally from the shell and positioned over the tongue plate and spaced therefrom by a predetermined distance less than the distance the shell will be deflected under heavy loading so that the ribs engage the tongue plate which engages the frame bottom wall and thereby supports the front portion of the shell when deflected, said ribs being spaced with openings therebetween to reduce cross sectional thickness and to decrease mold cycling time and the distortion of the plastic during cooling.

2. A safety belt buckle in accordance with claim 1 in which side walls on the shell have horizontally extending edges, fore and aft side walls on the bottom cover having grooves therein into which project the horizontally extending edges of the top cover shell.

3. A safety belt buckle in accordance with claim 2 in which the rear support includes depending ribs extending below the horizontal edges of the fore and aft shell sidewalls to be positioned to engage the frame bottom wall.

4. A safety belt buckle in accordance with claim 1 in which the ribs of the rear support include a pair of parallel walls extending fore and aft and depending on either side of the latch means and positioned and spaced to center the latch means therebetween.

5. A safety belt buckle in accordance with claim 1 in which the ribs have a substantially uniform cross-sectional thickness of about one millimeter and the shell wall has a cross sectional thickness less than 2 millimeter to reduce mold cycling time and distortion of the plastic during cooling.

6. A plastic cover for use with a safety belt buckle having a channel shaped frame with a bottom wall and a pair upstanding side walls and for use with a tongue plate slideable along the bottom wall of the frame, said cover comprising:

a one-piece plastic shell for covering the upper open side of the channel shaped frame and having an opening exposing a pushbutton operator for operation by a user, a plurality of side ribs on each side of the top cover depending internally from the shell for engaging the side walls of the channel shaped frame and for supporting the cover shell thereabove, a rear support having ribs depending internally at the rear of the shell for positioning to abut the frame bottom wall, a back wall on the shell extending to abut the bottom wall of the frame at the rearward side of the buckle, and a front support having a plurality of ribs depending internally from the shell for positioning over the tongue plate to be spaced therefrom by a predetermined distance less than the distance the shell will be deflected under heavy loading so that the ribs engage the tongue plate to support the front portion of the shell when deflected, said ribs being spaced with openings therebetween to reduce cross sectional thickness to decrease mold cycling time and distortion of the plastic during cooling.

7. A cover in accordance with claim 6 in which the ribs of the front support including fore and aft ribs intersected by transversely extending ribs to form a lattice work, said ribs terminating in lower edges defining a substantially horizontal plane to engage the top surface of the tongue plate when the front support is deflected downwardly.

8. A safety belt buckle in accordance with claim 6 in which the ribs of the front support including fore and aft ribs intersected by transversely extending ribs to form a lattice work, said ribs terminating in lower edges defining a substantially horizontal plane to engage the top surface of the tongue plate when the front support is deflected downwardly.

* * * * *